US005747764A

United States Patent [19]

Son et al.

[11] Patent Number: 5,747,764

[45] Date of Patent: May 5, 1998

[54] ELECTRIC POWER SWITCH FOR A VACUUM CLEANER WHICH HAS A SUCTION CONTROL FUNCTION

[75] Inventors: Chang-Woo Son; Yang-Rae Kim, both of Incheon, Rep. of Korea

[73] Assignee: Daewoo Electronics Co., Ltd., Seoul, Rep. of Korea

[21] Appl. No.: 792,161

[22] Filed: Jan. 30, 1997

[30] Foreign Application Priority Data

May 17, 1996 [KR] Rep. of Korea ..... 1996-16698

[51] Int. Cl.[6] ..... H01H 9/06

[52] U.S. Cl. ..... 200/61.86; 15/410; 439/192

[58] Field of Search ..... 15/41.1, 246.2, 15/143.1, 250, 202, 319, 323, 326, 327.1, 327.7, 321, 322, 344, 353, 339, 361, 410, 412, 413, 419; 200/16 R–16 D, 17 R, 52 R, 61.6, 61.85, 61.86, 81 R, 81.8, 837, 81 H, 293.1, 331, 332.2, 547, 548, 551; 434/384; 439/190–195

[56] References Cited

U.S. PATENT DOCUMENTS

| | | | |
|---|---|---|---|
| 2,197,337 | 4/1940 | Doughman | 200/52 |
| 4,366,351 | 12/1982 | Ditzig | 200/16 R |
| 4,658,101 | 4/1987 | Akimoto et al. | 200/16 R |
| 4,845,803 | 7/1989 | King | 15/339 |
| 4,915,640 | 4/1990 | Hayden | 439/191 |
| 4,987,637 | 1/1991 | Zummer et al. | 15/328 |
| 5,331,715 | 7/1994 | Johnson et al. | 15/332 |
| 5,472,346 | 12/1995 | Gray et al. | 439/23 |

FOREIGN PATENT DOCUMENTS

| | | | |
|---|---|---|---|
| 2 100 592 | 1/1983 | United Kingdom | A47L 9/28 |

*Primary Examiner*—Michael L. Gellner
*Assistant Examiner*—Michael A. Friedhofer

[57] ABSTRACT

An electric power switch for a vacuum cleaner which is capable of applying an electric voltage to a motor of the vacuum cleaner, capable of controlling a suction force which is established by the motor, is convenient to use, and can be manufactured at a low cost. An air suction passage for introducing an atmospheric air into a handle of the vacuum cleaner extends from a one side wall of a pipe hose toward a cover of the handle in order to communicate with the pipe hose. An operation knob is disposed in a space between the air suction passage and the cover and allows the air suction passage to selectively communicate with an air suction port, which is formed through the cover. A first supporting member for slideably supporting the operation knob extends from a bottom wall of the handle toward the cover up to an upper surface of the air suction passage. A plurality of locking grooves for setting a displacement of the operation knob are formed on an upper surface of the first supporting member. Locking grooves consist of a plurality of on-grooves and an off-groove which are arranged in a row. A second protrusion of the electric power switch selectively engages with the on-grooves and the off-groove in order to set the displacement of the operation knob.

20 Claims, 6 Drawing Sheets

ELECTRIC POWER SWITCH FOR A VACUUM CLEANER WHICH HAS A SUCTION CONTROL FUNCTION

BACKGROUND OF THE INVENTION

1. Field of the Invention

The present invention relates to an electric power switch for a vacuum cleaner, and more particularly to an electric power switch for a vacuum cleaner which is capable of applying an electric voltage to a motor of the vacuum cleaner, is capable of controlling a suction force which is established by the motor, is convenient to use, and can be manufactured at a low cost.

2. Description of the Prior Art

A variety of vacuum cleaners for easily removing dust or other foreign substances piled up on furniture, a floor, or a carpet in a room have been proposed hitherto. Generally, vacuum cleaners can be classified into canister-type vacuum cleaners and upright-type vacuum cleaners.

A canister-type vacuum cleaner includes a body mounted on wheels and a hose assembly for sucking dust or other foreign substances into the body. A suction generating means such as a suction fan, a motor for driving the suction generating means, and a disposable dust container for filtering dust or other foreign substances from air sucked by the vacuum cleaner, are positioned in the body. A main brush and a suction nozzle are provided at a free end of the hose assembly.

An upright-type vacuum cleaner has a constitution which is similar to that of the canister-type vacuum cleaner. However, the upright-type vacuum cleaner differs in that it vacuums a surface directly beneath its body, so a hose assembly is not required.

These days, the canister-type vacuum cleaner is more frequently used in the home than the upright-type vacuum.

FIG. 6 illustrates a canister-type vacuum cleaner 100. Vacuum cleaner 100 includes a floor cleaning unit 110, a canister unit 120, and a hose assembly 130 extending between floor cleaning unit 110 and canister unit 120.

Floor cleaning unit 110 includes a main brush (not shown) or a suction nozzle (not shown), and the like. Floor cleaning unit 110 is detachably connected to hose assembly 130.

Canister unit 120 mainly includes a hood 122, a cover 124 and a body 126. Hood 122 encloses a dust collecting compartment (not shown) and is pivotally installed onto body 126 so that the dust collecting compartment can be opened and closed. Hood 122 is provided with an inlet opening 127 formed through hood 122 for receiving hose assembly 130. Hood 122 also is provided with a transparent window 128 for notifying the user of the dust collecting state. Cover 124 encloses a motor compartment (not shown) where an electric motor and a suction fan driven by the electric motor are positioned. Further, a main electric cord 129 for applying an electric power from an external electric source to vacuum cleaner 100 is installed in the motor compartment. Main electric cord 129 is provided with a plug 129*a* at its free end.

Hose assembly 130 comprises a rigid wand 132 and a flexible hose 134, and is pneumatically connected to the dust collecting compartment of canister unit 120 by a suction hose connector 136. Rigid wand 132 is rotatably connected to flexible hose 134 by a handle assembly 200.

Meanwhile, FIG. 7 illustrates the conventional handle assembly 200 in detail. Handle assembly 200 mainly includes a pipe hose 131, a rotating connection portion 140 and a handle 170.

A free end of pipe hose 131 is detachably connected to an end of rigid wand 132. A suction control member 320 is rotatably mounted to rigid wand 132 at a position adjacent to pipe hose 131. Suction control member 320 has a cylindrical-shape, and a one side of suction control member 320 is cut off. Suction control member 320 is inserted into a plurality of first annular grooves 132*b* which are formed in an outer wall 132*a* of rigid wand 132. A first air suction port 322 is formed through a center of suction control member 320. First air suction port 322 is selectively communicated with a second air suction port 138, which is formed through outer wall 132*a* of rigid wand 132, in accordance with a rotating displacement of suction control member 320.

A button pipe 330 for separably receiving the end of rigid wand 132 is installed at an upper portion of pipe hose 131. Button pipe 330 is exposed to an outside through an opening 404 which is formed through a cover 172 of handle 170. Button pipe 330 includes a body 332, a fixing member 334 and a locking protrusion 336. When a user of the vacuum cleaner 100 presses button pipe 330 in order to insert the end of rigid wand 132 into pipe hose 131, locking protrusion 336 is inserted into a locking groove 139 which is formed on an outer periphery of rigid wand 132.

Button pipe 330 is elastically supported by a compression spring 340. For this purpose, an upper end of compression spring 340 is fixed to fixing member 334 of pipe hose 131. A lower end of compression spring 340 is fixed to a fixing rib 135 extending in the horizontal direction from a free end of pipe hose 131 to an interior of handle 170.

Meanwhile, pipe hose 131 is rotatably connected to flexible hose 134 by rotating connection portion 140. For this purpose, a second annular groove 133 is formed on an outer periphery of a distal end 137 of pipe hose 131. An elastic C-shaped ring 304 is inserted into and fixed in second annular groove 133. A third annular groove 306 is formed on an inner periphery of front end 302 of rotating connection portion 140. If a user of vacuum cleaner 100 rotates handle 170 under the state that distal end 137 of pipe hose 131 and front end 302 of rotating connection portion 140 are connected with each other as described above, C-shaped ring 304 rotates in third annular groove 306. As a result, pipe hose 131 and rotating connection portion 140 can rotate together in 360 degrees.

Meanwhile, handle 170 is integrally formed with pipe hose 131. A cover 172 of handle 170 is fixed to fixing rib 135 and a bottom wall 174 of handle 170 by a plurality of first screws 143. An electric power switch 350 is mounted to an upper portion of handle 170. Electric power switch 350 includes an operation knob 352, a curved first electric terminal 354, a flat second electric terminal 356, an insulation member 358 which is disposed between first electric terminal 354 and second electric terminal 356, and a supporting member 360 for supporting first electric terminal 354 and a flat second electric terminal 356.

Operation knob 352 is slideably positioned in a sliding groove 173 which is formed through cover 172 of handle 170. Operation knob 352 slideably makes contact with first electric terminal 354 through a pressing portion 352*a* protruding downward from a front end of operation knob 352. That is, when a user of the vacuum cleaner 100 operates operation knob 352 in order to apply an electric voltage to the motor and to change the applied electric voltage, operation knob 352 slideably moves in the longitudinal direction along sliding groove 173 and makes contact with first electric terminal 354 through a pressing portion 352*a*.

Supporting member 360 for supporting first electric terminal 354 and second electric terminal 356 is fixed to a one side wall 131*a* of pipe hose 131 and to bottom wall 174 of handle 170 by a plurality of second screws 145. A plurality of lead wires 312 are connected to rear ends of first electric terminal 354 and second electric terminal 356, which are positioned on supporting member 360. Lead wires 312 extend from the rear ends of first electric terminal 354 and second electric terminal 356 to rotating connection portion 140. That is, lead wires 312 extending from the rear ends of first electric terminal 354 and second electric terminal 356 extend into rotating connection portion 140 through a through hole 150 which is formed through one side wall 131*a* of pipe hose 131.

In a lower end 314 of rotating connection portion 140, lead wires 312 extending into rotating connection portion 140 are connected to an inner electric wire (not shown) extending from a printed circuit board (not shown, hereinafter referred to "PCB"), which is installed in canister unit 120, into rotating connection portion 140 along flexible hose 134. After lead wires 312 are welded to the inner electric wire, lead wires 312 are fixed to lower end 314 by an insulating vinyl tape 316.

When an electrical connection between lead wires 312 and the inner electric wire is completed, a cover hose 318 is mounted onto lower end 314 of rotating connection portion 140 in consideration of an external appearance of handle assembly 200. Cover hose 318 is mounted onto a rib 322 which is formed on a frame 320 of rotating connection portion 140.

When a user wants to perform a cleaning job by using vacuum cleaner 100 as described above, the user inserts plug 129*a* of main electric cord 129 into an outlet wall (not shown). Thereafter, the user starts a suction operation by turning on electric power switch 350. That is, if the user of vacuum cleaner 100 pushes operation knob 352 of electric power switch 350 toward pipe hose 131, pressing portion 352*a* protruding into handle 170 moves toward pipe hose 131 while pressing portion 352*a* presses first electric terminal 354.

Then, a front end of first electric terminal 354 is brought into contact with second electric terminal 354. Thereby, an electric voltage, which is applied from an outer electric source to electric power switch 350, is applied to the motor which is installed in canister unit 120. As a result, the motor of vacuum cleaner 100 is operated. Under this state, the user of vacuum cleaner 100 slideably moves floor cleaning unit 110 along the surface to be cleaned so that the cleaning job can be performed.

At this time, the user of vacuum cleaner 100 controls a vacuum suction by using suction control member 320, which is mounted to rigid wand 132, in order to obtain a desired vacuum suction with respect to an object and a place to be cleaned. That is, an air-communication degree of first air suction port 322 and second air suction port 338 is controlled by controlling a rotating degree of suction control member 320. Then, an amount of air sucked into vacuum cleaner 100 through first air suction port 322 and second air suction port 338 is controlled. Thereby, the user of vacuum cleaner 100 controls a vacuum suction, which is established by the motor, at a desired set value.

However, in vacuum cleaner 100 as described above, electric power switch 350 for operating vacuum cleaner 100 and suction control member 320 for controlling a suction are spaced apart from each other as separate elements. Therefore, in order to perform a cleaning job, it is necessary to operate both electric power switch 350 and suction control member 320. Accordingly, vacuum cleaner 100 is inconvenient to use, and a cleaning efficiency of vacuum cleaner 100 is low. Further, a structure of vacuum cleaner 100 is complicated, and the manufacturing cost of vacuum cleaner 100 is high.

U.S. Pat. No. 5,472,346 issued to Steven L. Gray et al. on Dec. 5, 1995 discloses a swivel joint for a vacuum cleaner. Steven L. Gray et al.'s swivel joint is provided with an on/off switch for controlling a motor of the vacuum cleaner and a slide valve for introducing an atmospheric air into a handle. The on/off switch and the slide valve are installed to a handle assembly of the vacuum cleaner. The slide valve slides along the length of the handle to open or close an opening in a suction conduit in the top of the handle.

However, Steven L. Gray et al.'s swivel joint employs an on/off switch and a slide switch which have functions similar to those of the conventional electric power switch and the conventional suction control member as described above. Accordingly, Steven L. Gray et al.'s swivel joint is inconvenient to use and a cleaning efficiency of a vacuum cleaner having a Steven L. Gray et al.'s swivel joint is low.

SUMMARY OF THE INVENTION

The present invention is contrived to solve the foregoing problems. It is an object of the present invention to provide an electric power switch for a vacuum cleaner which is capable of applying an electric voltage to a motor of the vacuum cleaner, is capable of controlling a suction force which is established by the motor, is convenient to use, and can be manufactured at a low cost.

In order to achieve the above object, the present invention provides an electric power switch for a vacuum cleaner, said electric power switch comprising:

an air suction passage for introducing an atmospheric air into the vacuum cleaner, the air suction passage being installed in a handle of the vacuum cleaner and extending from a one side wall of a pipe hose toward a cover of the handle in order to communicate with the pipe hose of the vacuum cleaner;

an operation knob for allowing the air suction passage to selectively communicate with an air suction port which is formed through the cover, the operation knob being installed in a space between the air suction passage and the cover;

a first supporting member for setting a displacement of the operation knob and for slideably supporting the operation knob, the first supporting member extending from a bottom wall of the handle toward the cover in a direction parallel with the air suction passage;

a plurality of electric terminals for applying an electric voltage to a motor of the vacuum cleaner by receiving a pressing force from the operation knob; and a second supporting member for supporting the electric terminals.

The air suction passage has a cylindrical-shape, and a center line of the air suction passage is the same as a center line of the air suction port. A diameter of the air suction passage is the same as a diameter of the air suction port.

The operation knob includes a body, a first protrusion which is exposed to an outside through a first through hole in order to allow a user of the vacuum cleaner to operate the operation knob, a pressing portion for pressing the electric terminals in order to apply an electric voltage to the motor, a second protrusion protruding downward from a rear end of the body and engaging with an upper surface of the first supporting member in order to set a displacement of the operation knob, and a second through hole which is formed through the body in order to allow the air suction passage to communicate with the air suction port.

The first protrusion protrudes upward from the rear end of the body. The first through hole is formed through the cover. The pressing portion protrudes downward from a front end of the body.

A diameter of the second through hole is the same as a diameter of the air suction port.

The first supporting member extends from a bottom wall of the handle toward the cover up to an upper surface of the air suction passage so that the first supporting member and the air suction passage form a sliding surface for the operation knob. The first supporting member includes a plurality of locking grooves which are formed on the upper surface of the first supporting member in order to set a displacement of the operation knob.

The locking grooves include a plurality of on-grooves and an off-groove which are arranged in a row. The off-groove is formed at a distal end of the upper surface of the first supporting member.

The electric terminals include a curved first electric terminal which is brought into direct contact with the operation knob, a flat second electric terminal which is disposed below the first electric terminal and is brought into contact with the first electric terminal at the time that the operation knob presses the first electric terminal, and an insulation member which is disposed between the first electric terminal and the second electric terminal.

The second supporting member includes screw receiving holes which are formed through both ends of the second supporting member. The second supporting member is fixed to the one side wall of the pipe hose by a plurality of screws passing through the screw receiving holes.

As described above, the electric power switch for the vacuum cleaner according to the preferred embodiment of the present invention includes the upright air suction passage for introducing an air at an atmosphere into the vacuum cleaner, and controls a degree of opening and closing of the air suction passage by using the operation knob. Accordingly, it is possible to operate the motor of the vacuum cleaner and to conveniently control as needed a vacuum suction established by the motor.

BRIEF DESCRIPTION OF THE DRAWINGS

The above object and other characteristics and advantages of the present invention will become more apparent by describing in detail a preferred embodiment thereof with reference to the attached drawings, in which.

DETAILED DESCRIPTION OF THE INVENTION

Hereinafter, the preferred embodiment of the present invention will be explained in more detail with reference to the accompanying drawings.

Figure 1:
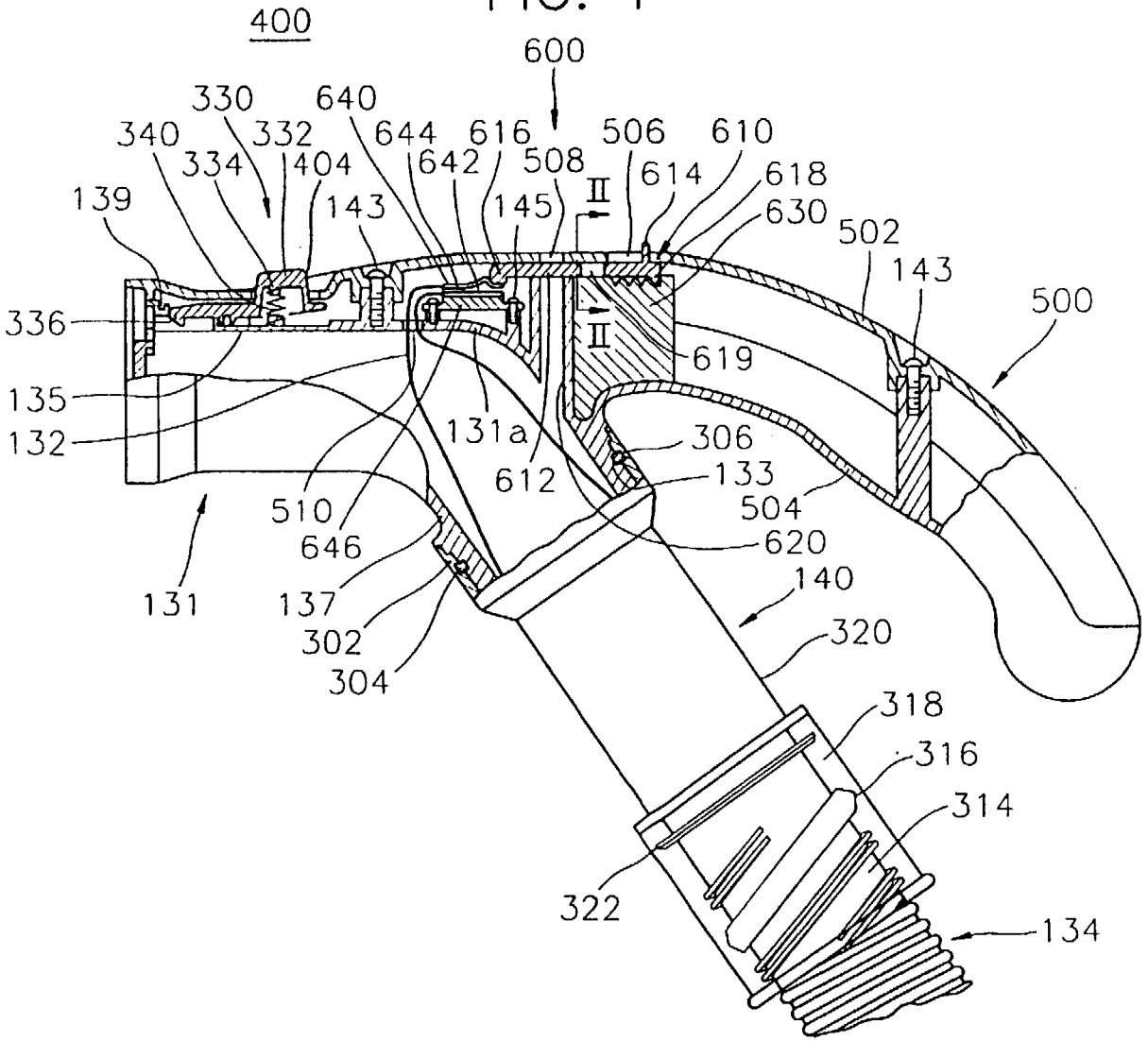
FIG. 1 is a partially sectional view of a handle assembly for a vacuum cleaner according to a preferred first embodiment of the present invention.

FIG. 1 illustrates in detail an internal structure of a handle assembly 400 having an electric power switch 600 according to the present invention. Handle assembly 400 mainly includes a pipe hose 131, a rotating connection portion 140 and a handle 500. A free end of pipe hose 131 is detachably connected to an end of rigid wand 132. For this purpose, a button pipe 330 for separably receiving the end of rigid wand 132 is installed at an upper portion of pipe hose 131.

Button pipe 330 is exposed to an outside so that a user of vacuum cleaner 100 can press button pipe 330 by hand. That is, button pipe 330 is exposed to an outside through an opening 404 which is formed through a cover 502 of handle 500. Button pipe 330 includes a body 332, a fixing member 334 and a locking protrusion 336. Fixing member 334 extends downward from body 332. Locking protrusion 336 extends in the horizontal direction from body 332 to an open end of pipe hose 131. When a user of the vacuum cleaner 100 presses button pipe 330 in order to insert the end of rigid wand 132 into pipe hose 131, locking protrusion 336 is inserted into a locking groove 139 which is formed on an outer periphery of rigid wand 132.

Button pipe 330 is elastically supported by a compression spring 340. For this purpose, an upper end of compression spring 340 is fixed to fixing member 334 of pipe hose 131. A lower end of compression spring 340 is fixed to a fixing rib 135 extending in the horizontal direction from a free end of pipe hose 131 to an interior of handle 500.

Meanwhile, pipe hose 131 is rotatably connected to flexible hose 134 by rotating connection portion 140. For this purpose, a first annular groove 133 is formed on an outer periphery of a distal end 137 of pipe hose 131. An elastic C-shaped ring 304 is inserted into and fixed in first annular groove 133. A second annular groove 306 is formed on an inner periphery of front end 302 of rotating connection portion 140. Second annular groove 306 corresponds to first annular groove 133.

If a user of the vacuum cleaner 100 rotates handle 500 under the state where distal end 137 of pipe hose 131 and front end 302 of rotating connection portion 140 are connected with each other as described above, C-shaped ring 304 rotates in second annular groove 306 in accordance with the rotating of distal end 137 of pipe hose 131 in relation to front end 302 of rotating connection portion 140. As a result, pipe hose 131 and rotating connection portion 140 can rotate together in 360 degrees.

Meanwhile, handle 500 is integrally formed with pipe hose 131. Handle 500 is designed to have a desired shape based on a human engineering so that a user of vacuum cleaner 100 can conveniently grip handle 500 by hand. Cover 502 of handle 500 is fixed to fixing rib 135 and to a bottom wall 504 of handle 500 by a plurality of first screws 143.

Electric power switch 600 is mounted to an upper portion of handle 500. Electric power switch 600 includes an elongated operation knob 610, an upright cylindrical-shaped air suction passage 620 for sucking air at an atmosphere into vacuum cleaner 100, a first supporting member 630 for slideably supporting operation knob 610, a curved first electric terminal 640, a flat second electric terminal 642, an insulation member 644 which is disposed between first electric terminal 640 and second electric terminal 642, and a second supporting member 646 for supporting first electric terminal 640 and second electric terminal 642.

Figure 2:
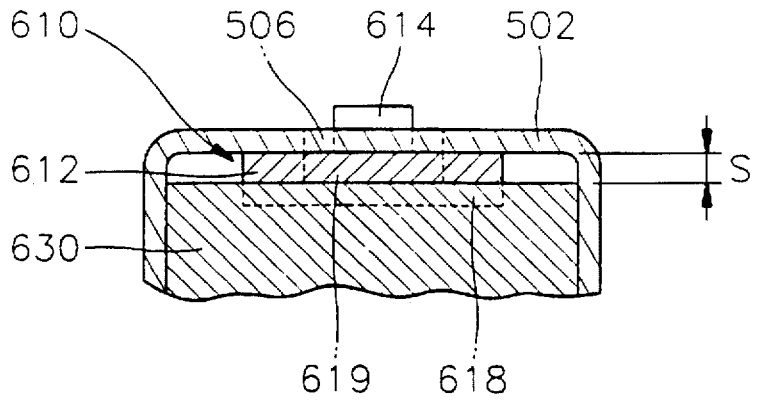
FIG. 2 is a sectional view taken along line II—II shown in FIG. 1.

Operation knob 610 is made of a plastic by using an injection molding process. FIG. 2 illustrates a disposition state of operation knob 610. Operation knob 610 is disposed at a space (S) which is established between cover 502 of handle 500 and an upper surface of first supporting member 630. Operation knob 610 has a smooth upper surface and a smooth bottom surface so that operation knob 610 slideably makes contact with a bottom surface of cover 502 and an upper surface of first supporting member 630.

Referring to FIG. 1, when a user of vacuum cleaner 100 controls operation knob 610 in order to change an electric voltage which is applied to the motor, operation knob 610 moves in the horizontal direction and selectively opens and closes air suction passage 620. For this purpose, operation knob 610 includes an elongated body 612, a first protrusion 614, a pressing porion 616, a second protrusion 618 and a first through hole 619. First protrusion 614 protrudes from body 612 upward at a rear portion of body 612. First protrusion 614 is exposed to an outside so that the user of vacuum cleaner 100 can operate first protrusion 614 by hand.

Figure 3:
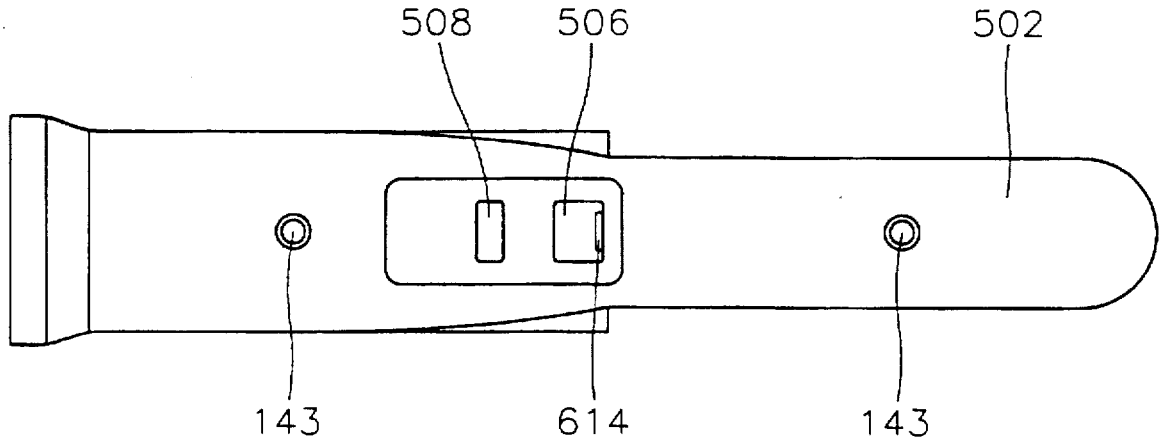
FIG. 3 is a plan view of the handle assembly for the vacuum cleaner illustrated in FIG. 1.

FIG. 3 illustrates a state that first protrusion 614 of operation knob 610 is exposed to an outside of handle assembly 400. First protrusion 614 is exposed to an outside of handle assembly 400 through a sliding groove 506 which is formed through cover 502 of handle 500 so that the user of vacuum cleaner 100 can operate first protrusion 614 by hand. First protrusion 614 slideably moves in the horizontal direction along sliding groove 506 by a pushing force applied by the user of vacuum cleaner 100.

Figure 4:
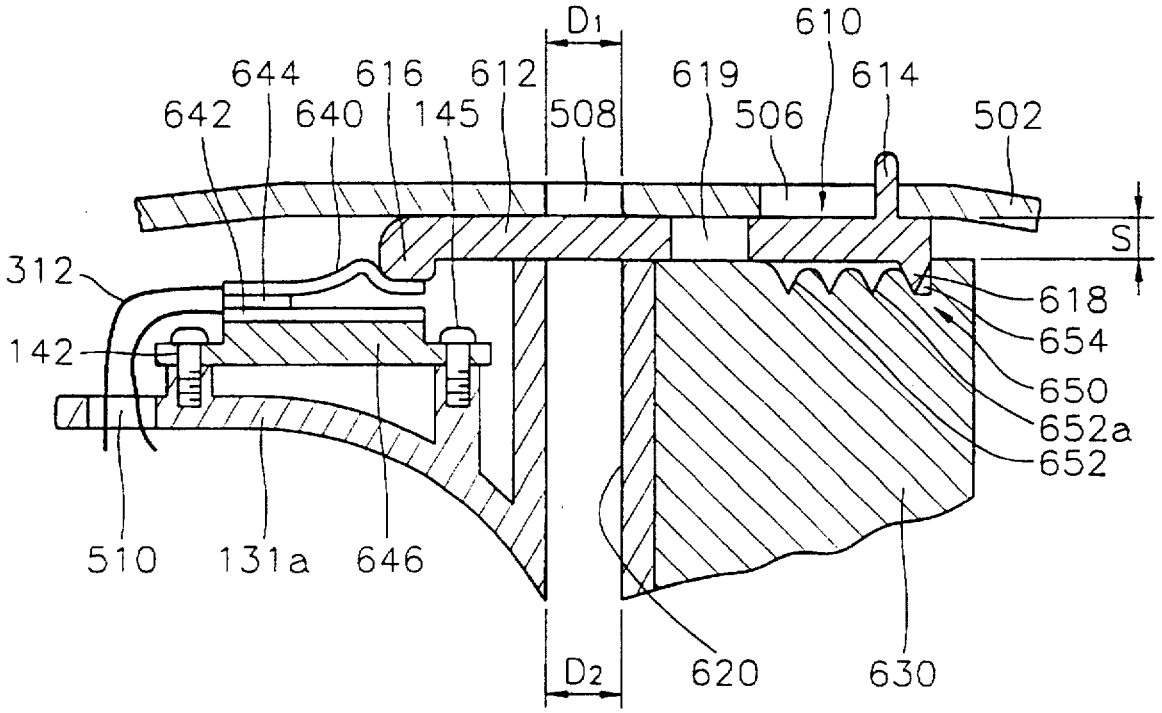
FIG. 4 is a partially enlarged view of FIG. 1.

FIG. 4 illustrates in detail an internal structure of electric power switch 600 according to the present invention. Referring to FIG. 4, pressing portion 616 of operation knob 610 protrudes downward from body 612 at a front end of body 612. Pressing portion 616 slideably makes contact with first electric terminal 640. For this purpose, pressing portion 616 is curved downward from body 612 of operation knob 610 so that pressing portion 616 has a predetermined shape. When a user of vacuum cleaner 100 pushes first protrusion 612 of operation knob 610 toward pipe hose 131 in order to apply an electric voltage to a motor and change the applied electric voltage, pressing portion 616 moves toward pipe hose 131 and presses first electric terminal 640 downward.

Second protrusion 618 protrudes from body 612 downward at the rear end of operation knob 610. In order to set a displacement of operation knob 610, second protrusion 618 engages with a plurality of locking grooves 650 which are formed on the upper surface of first supporting member 630. That is, in order to stop operating vacuum cleaner 100, second protrusion 618 is inserted into an off-groove 654 which is formed on the upper surface of first supporting member 630. If a user of vacuum cleaner 100 pushes first protrusion 612 of operation knob 610 toward pipe hose 131 in order to apply an electric voltage to the motor and change the applied electric voltage, second protrusion 618 is inserted into a plurality of on-grooves 652 in due sequence, which are formed in front of off-groove 654 on the upper surface of first supporting member 630. That is, second protrusion 618 is selectively inserted into on-grooves 652 in accordance with a displacement of operation knob 610.

First through hole 619 is formed through a center of operation knob 610. First through hole 619 allows for communication of air suction passage 620 with air suction port 508 as needed. That is, if a user of vacuum cleaner 100 pushes first protrusion 612 of operation knob 610 toward pipe hose 131 in order to apply an electric voltage to the motor and change the applied electric voltage, first through hole 619 is communicated with air suction port 508 which is formed through cover 502.

Meanwhile, air suction passage 620 is installed in handle 500. That is, air suction passage 620 extends from one side wall 131*a* of pipe hose 131 toward cover 502 of handle 500 so that air suction passage 620 is communicated with pipe hose 131. In order to introduce air at an atmosphere into handle 500, air suction passage 620 stands erect so that air suction passage 620 and air suction port 508, which is formed through cover 502 of handle 500, are arranged in a row. A center line of air suction passage 620 is the same as a center line of air suction port 508. Preferably, a diameter $D_2$ of air suction passage 620 is the same as a diameter $D_1$ of air suction port 508.

If a user of vacuum cleaner 100 pushes first protrusion 612 of operation knob 610 toward pipe hose 131 in order to apply an electric voltage to the motor and change the applied electric voltage, air suction passage 620 allows for introducing an amount of air in accordance with a displacement of operation knob 610. That is, air suction passage 620 plays the role of an air flowing passageway. In other words, when operation knob 610 moves toward pipe hose 131 by a force applied by the user of vacuum cleaner 100, air suction port 508, first through hole 619 and air suction passage 620 are arranged in a row. Then, an atmosphere air is introduced from an outside of handle assembly 400 into handle assembly 400.

First supporting member 630 for slideably supporting operation knob 610 is formed at a right side of air suction passage 620. First supporting member 630 extends from bottom wall 504 of handle 500 toward cover 502 in a direction parallel with air suction passage 620. First supporting member 630 extends up to the upper surface of air suction passage 620 so that first supporting member 630 and air suction passage 620 form a sliding surface.

As described above, locking grooves 650 for setting a displacement of operation knob 610 are formed on first supporting member 630. Locking grooves 650 consist of on-grooves 652 and off-groove 654 which are formed on the upper surface of first supporting member 630 in a single line. Off-groove 654 is formed at a distal end of the upper surface of first supporting member 630. Second protrusion 618 is inserted into on-grooves 652 and off-groove 654 in accordance with a displacement of operation knob 610.

Second supporting member 646, for supporting first electric terminal 640 and second electric terminal 642, includes a screw receiving hole 142 which is formed through both ends of second supporting member 644. Second supporting member 644 is fixed to one side wall 131*a* of pipe hose 131 by a plurality of second screws 145 passing through screw receiving hole 142. A plurality of lead wires 312 are connected to front ends of first electric terminal 640 and second electric terminal 642, which are positioned on second supporting member 644.

Lead wires 312 extend from the front ends of first electric terminal 640 and second electric terminal 642 into rotating connection portion 140. That is, lead wires 312 extending from the front ends of first electric terminal 640 and second electric terminal 642 extend to an interior of rotating connection portion 140 through a through hole 510 which is formed through one side wall 131*a* of pipe hose 131.

Referring to FIG. 1 again, lead wires 312 extending into rotating connection portion 140 are electrically connected to a ring-shaped cover terminal (not shown) through a plurality of ring-shaped frame terminals (not shown). The ring-shaped cover terminal and the ring-shaped frame terminals are installed in rotating connection portion 140. In lower end 314 of rotating connection portion 140, lead wires 312 extending from a free end of cover terminal is connected to an inner electric wire (not shown) extending from the PCB into rotating connection portion 140 along flexible hose 134. After lead wires 312 are welded to the inner electric wire, lead wires 312 are fixed to lower end 314 by an insulating vinyl tape 316.

When an electrical connection between lead wires 312 and the inner electric wire is completed, a cover hose 318 is mounted onto lower end 314 of rotating connection portion 140 in consideration of an external appearance of handle assembly 400. Cover hose 318 is mounted onto a rib 322 which is formed on frame 320.

Hereinbelow, an operation process of vacuum cleaner 100 having electric power switch 600 as described above will be briefly described.

First, a user of vacuum cleaner 100 inserts plug 129*a* of main electric cord 129 into an outlet (not shown). Next, the user moves operation knob 610 of electric power switch 600 in order to drive the motor of vacuum cleaner 100. That is, the user of vacuum cleaner 100 pushes first protrusion 618 of operation knob 610 toward pipe hose 131. Then, second protrusion 618 of operation knob 610 is released from off-groove 654, which is formed on the upper surface of first supporting member 630, and is inserted into a first on-groove 652*a* among on-grooves 652, which are formed in front of off-groove 654, by a pushing force applied by the user.

As a result, an electric voltage is applied from electric power switch 600 to the motor of vacuum cleaner 100 so that the motor of vacuum cleaner 100 begins to operate. Under this state, the user of vacuum cleaner 100 slideably moves floor cleaning unit 110 along the surface to be cleaned so that the cleaning job can be performed.

Meanwhile, if a vacuum suction established by the motor excessively rises above a desired vacuum suction, the user of vacuum cleaner 100 controls the vacuum suction by moving operation knob 610.

Figure 5:
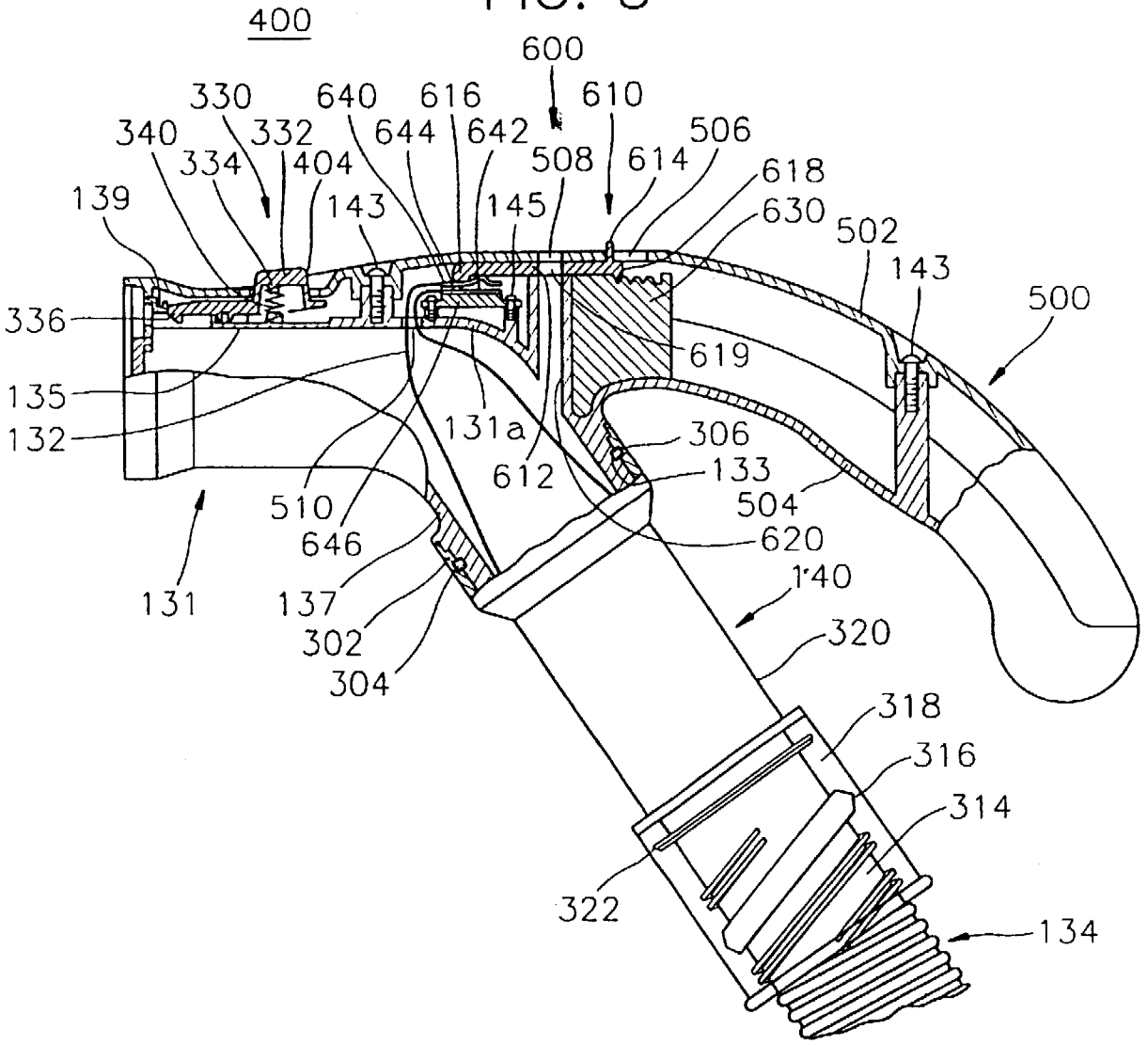
FIG. 5 is a partially sectional view of the handle assembly for the vacuum cleaner for showing the state that an operation knob of an electric power switch illustrated in FIG. 1 has been moved to a position for completely opening an air suction passage.
Figure 6:
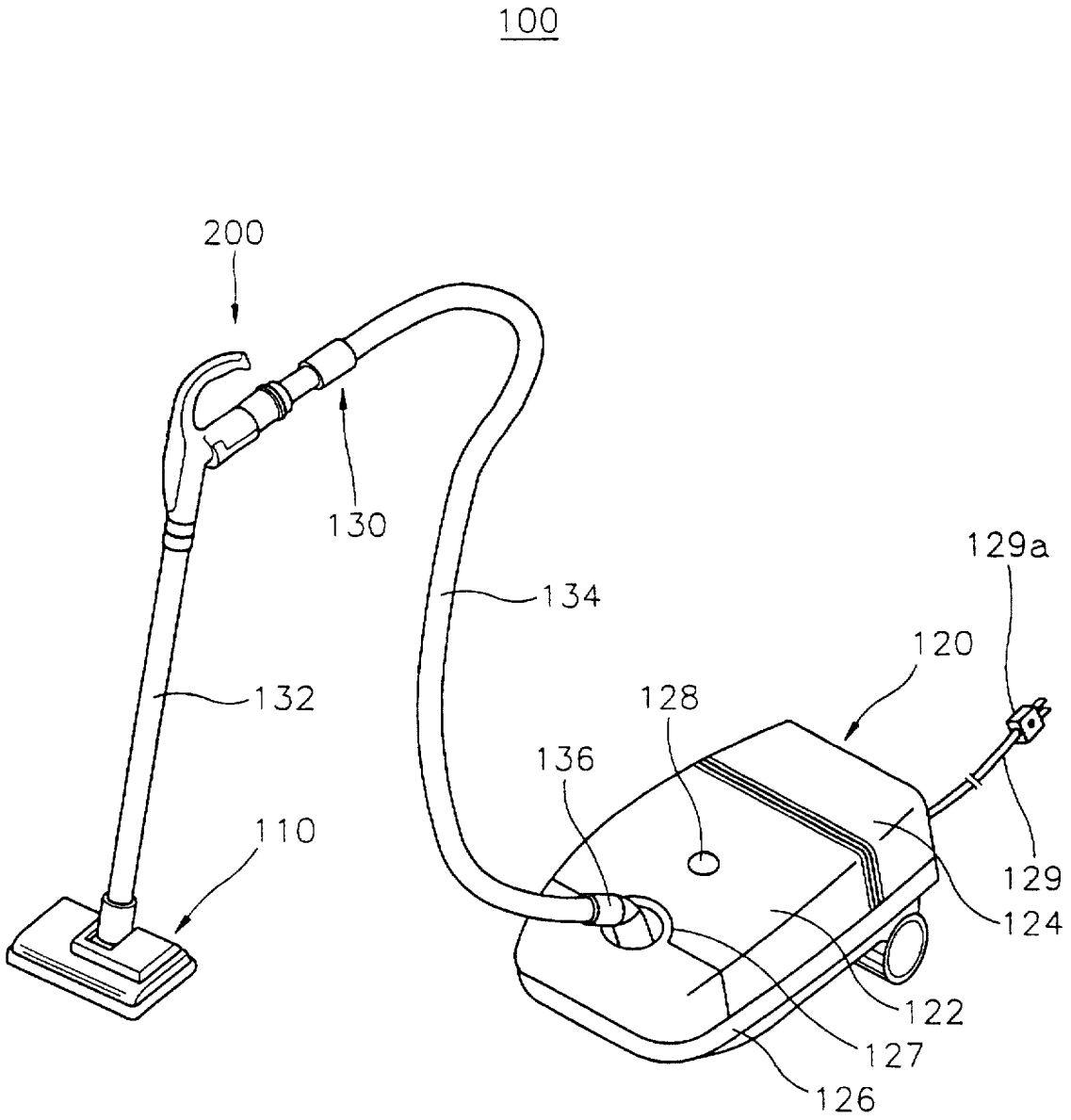
FIG. 6 (PRIOR ART)
FIG. 6 is a perspective view of a canister-type vacuum cleaner according to the prior art.
Figure 7:
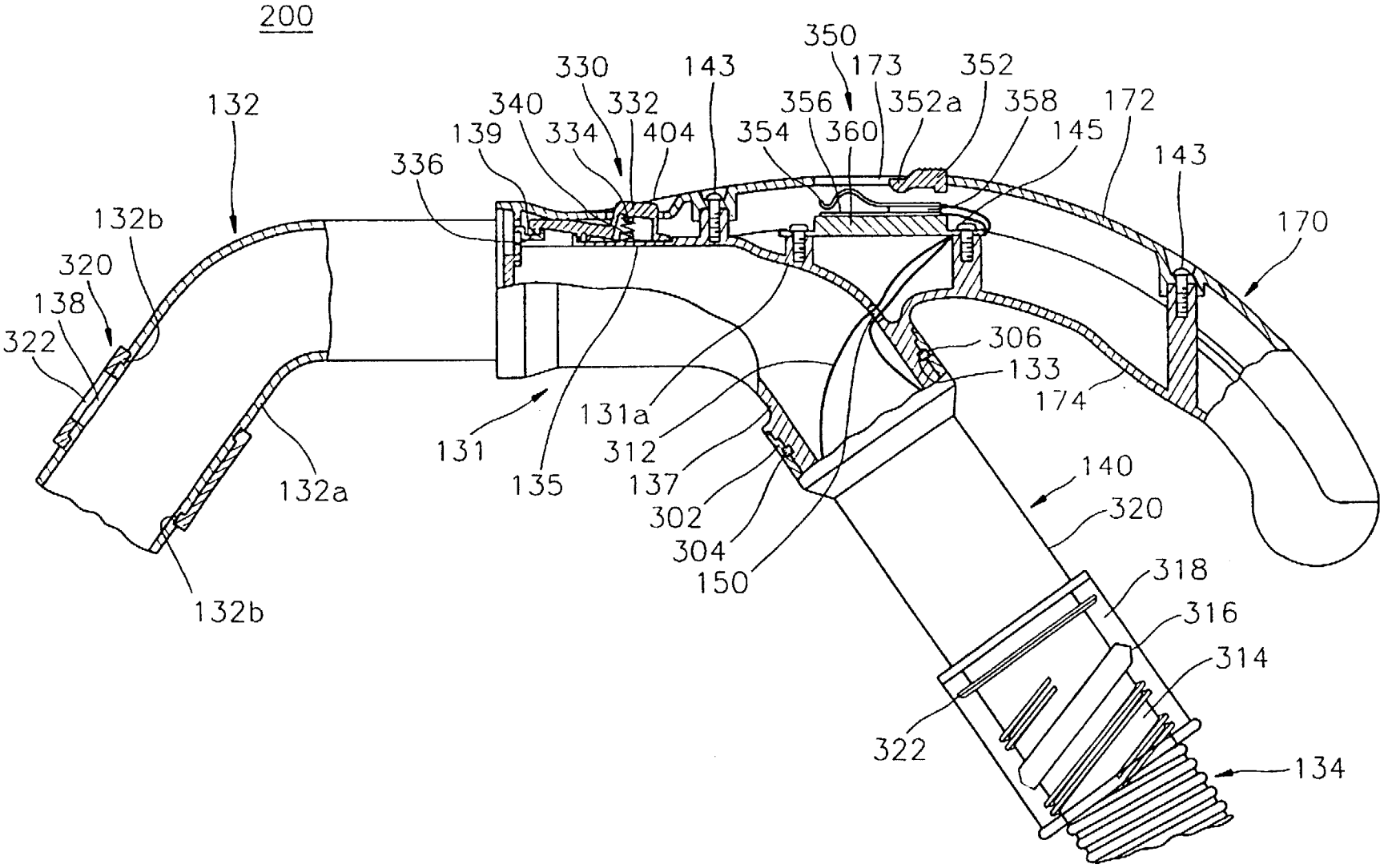
FIG. 7 (PRIOR ART)
FIG. 7 is a partially sectional view of a handle assembly for a vacuum cleaner according to a prior art.

FIG. 5 illustrates a state where operation knob 610 has been moved to a position for completely opening air suction passage 620. Referring to FIG. 5, the user of vacuum cleaner 100 continuously pushes pipe hose 131 toward first protrusion 618 in order to descend the vacuum suction established by the motor. Then, second protrusion 618 is released from first on-groove 652*a* and is inserted into other off-groove 652, which is formed in front of first on-groove 652*a*.

At this time, operation knob 610 moves toward pipe hose 131 and allows for communication air suction port 508 with air suction passage 620. That is, air suction port 508 which is formed through cover 502, first through hole 619 which is formed through operation knob 610, and air suction passage 620 are communicated with each other. As a result, an air at an atmosphere is sucked into handle assembly 400 through air suction port 508, first through hole 619 and air suction passage 620, which are arranged in a row. Thereby, a vacuum pressure established by the motor of vacuum cleaner 100 decreases, and the user of vacuum cleaner 100 can obtain a desired vacuum pressure.

As described above, the electric power switch for the vacuum cleaner according to the preferred embodiment of the present invention includes the upright air suction passage 620 for introducing an air at an atmosphere into vacuum cleaner 100, and controls a degree of opening and closing of air suction passage 620 by using operation knob 610. Accordingly, it is possible to operate the motor of vacuum cleaner 100 and to conveniently control as needed a vacuum suction established by the motor. Further, since it is unnecessary to install the conventional air suction passage 320 on rigid wand 132, an internal structure of handle assembly 400 is simplified, so the effect of lowering the manufacturing cost of handle assembly 400 can be obtained.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. An electric power switch for a vacuum cleaner, said electric power switch comprising:

an air suction passage for introducing an atmospheric air into the vacuum cleaner, said air suction passage being installed in a handle of the vacuum cleaner and extending from a one side wall of a pipe hose toward a cover of the handle in order to communicate with the pipe hose of the vacuum cleaner;

an operation knob for allowing said air suction passage to selectively communicate with an air suction port which is formed through the cover, said operation knob being installed in a space between said air suction passage and the cover;

a first supporting member for setting a displacement of said operation knob and for slideably supporting said operation knob, said first supporting member extending from a bottom wall of the handle toward the cover in a direction parallel with said air suction passage;

a plurality of electric terminals for applying an electric voltage to a motor of the vacuum cleaner by receiving a pressing force from said operation knob; and a second supporting member for supporting said electric terminals.

2. An electric power switch as claimed in claim 1, wherein said air suction passage has a cylindrical-shape, and a center line of said air suction passage is the same as a center line of the air suction port.

3. An electric power switch as claimed in claim 1, wherein a diameter of said air suction passage is the same as a diameter of the air suction port.

4. An electric power switch as claimed in claim 1, wherein said operation knob includes a body, a first protrusion which is exposed to an outside through a first through hole in order to allow a user of the vacuum cleaner to operate said operation knob, a pressing portion for pressing said electric terminals in order to apply an electric voltage to the motor, a second protrusion protruding downward from a rear end of said body and engaging with an upper surface of said first supporting member in order to set a displacement of said operation knob, and a second through hole which is formed through said body in order to allow said air suction passage to communicate with the air suction port, said first protrusion protruding upward from the rear end of said body, said first through hole being formed through the cover, and said pressing portion protruding downward from a front end of said body.

5. An electric power switch as claimed in claim 4, wherein a diameter of said second through hole is the same as a diameter of the air suction port.

6. An electric power switch as claimed in claim 1, wherein said first supporting member extends from the bottom wall of the handle toward the cover up to an upper surface of said air suction passage so that said first supporting member and said air suction passage form a sliding surface for said operation knob.

7. An electric power switch as claimed in claim 1, wherein said first supporting member includes a plurality of locking grooves which are formed on the upper surface of said first supporting member in order to set a displacement of said operation knob.

8. An electric power switch as claimed in claim 7, wherein said locking grooves include a plurality of on-grooves and an off-groove which are arranged in a row.

9. An electric power switch as claimed in claim 8, wherein said off-groove is formed at a distal end of the upper surface of said first supporting member.

10. An electric power switch as claimed in claim 1, wherein said electric terminals include a curved first electric terminal which is brought into direct contact with said operation knob, a flat second electric terminal which is disposed below said first electric terminal and is brought into contact with said first electric terminal at the time that said operation knob presses said first electric terminal, and an insulation member which is disposed between said first electric terminal and said second electric terminal.

11. An electric power switch as claimed in claim 1, wherein said second supporting member having two ends includes screw receiving holes which are formed through both of said ends of said second supporting member, said second supporting member is fixed to the one side wall of the pipe hose by a plurality of screws passing through the screw receiving holes.

12. An electric power switch for a vacuum cleaner, said electric power switch comprising:

an air suction passage for introducing an atmospheric air into the vacuum cleaner, said air suction passage being installed in a handle of the vacuum cleaner and extending from a one side wall of a pipe hose toward a cover of the handle in order to communicate with the pipe hose of the vacuum cleaner;

an operation knob for allowing said air suction passage to selectively communicate with an air suction port which is formed through the cover, said operation knob being installed in a space between said air suction passage and the cover, said operation knob including a body, a first protrusion which is exposed to an outside through a first through hole in order to allow a user of the vacuum cleaner to operate said operation knob, a pressing portion protruding downward from a front end of said body, a second protrusion for setting a displacement of said operation knob, and a second through hole which is formed through said body in order to allow said air suction passage to communicate with the air suction port, in which said first protrusion protrudes upward from a rear end of said body, said first through hole is formed through the cover, and said second protrusion protrudes downward from the rear end of said body;

a first supporting member for setting a displacement of said operation knob and for slideably supporting said operation knob, said first supporting member extending from a bottom wall of the handle toward the cover up to an upper surface of said air suction passage so that said first supporting member and said air suction passage form a sliding surface for said operation knob, and said first supporting member including a plurality of locking grooves which are formed on an upper surface of said first supporting member in order to set a displacement of said operation knob;

a plurality of electric terminals for applying an electric voltage to a motor of the vacuum cleaner by receiving a pressing force from said operation knob, said electric terminals including a curved first electric terminal which is brought into direct contact with said operation knob, a flat second electric terminal which is disposed below said first electric terminal and is brought into contact with said first electric terminal at the time that said operation knob presses said first electric terminal, and an insulation member which is disposed between said first electric terminal and said second electric terminal; and a second supporting member having two ends for supporting said electric terminals including screw receiving holes which are formed through both of said ends of said second supporting member, and said second supporting member being fixed to the one side wall of the pipe hose by a plurality of screws passing through the screw receiving holes.

13. An electric power switch as claimed in claim 12, wherein said air suction passage has a cylindrical-shape, and a center line of said air suction passage is the same as a center line of the air suction port.

14. An electric power switch as claimed in claim 12, wherein a diameter of said air suction passage is the same as a diameter of the air suction port.

15. An electric power switch as claimed in claim 12, wherein a diameter of said second through hole is the same as a diameter of the air suction port.

16. An electric power switch as claimed in claim 12, wherein said locking grooves include a plurality of on-grooves and an off-groove which are arranged in a row.

17. An electric power switch as claimed in claim 16, wherein said off-groove is formed at a distal end of the upper surface of said first supporting member.

18. An electric power switch for a vacuum cleaner, said electric power switch comprising:

(a) an air suction passage for introducing an atmospheric air into the vacuum cleaner, said air suction passage being installed in a handle of the vacuum cleaner and extending from a one side wall of a pipe hose toward a cover of the handle in order to communicate with the pipe hose of the vacuum cleaner;

(b) an operation knob for allowing said air suction passage to selectively communicate with an air suction port which is formed through the cover, said operation knob being installed in a space between said air suction passage and the cover, said operation knob including a body, a first protrusion which is exposed to an outside through a first through hole in order to allow a user of the vacuum cleaner to operate said operation knob, a pressing portion protruding downward from a front end of said body, a second protrusion for setting a displacement of said operation knob, and a second through hole which is formed through said body in order to allow said air suction passage to communicate with the air suction port, in which said first protrusion protrudes upward from a rear end of said body, said first through hole is formed through the cover, said second protrusion protrudes downward from the rear end of said body, and a diameter of said second through hole is the same as a diameter of the air suction port;

(c) a first supporting member for setting a displacement of said operation knob and for slideably supporting said operation knob, said first supporting member extending from a bottom wall of the handle toward the cover up to an upper surface of said air suction passage so that said first supporting member and said air suction passage form a sliding surface for said operation knob, and said first supporting member including a plurality of locking grooves which are formed on an upper surface of said first supporting member in order to set a displacement of said operation knob, in which said locking grooves include a plurality of on-grooves and an off-groove which are arranged in a row, and said off-groove is formed at a distal end of the upper surface of said first supporting member;

(d) a plurality of electric terminals for applying an electric voltage to a motor of the vacuum cleaner by receiving a pressing force from said operation knob, said electric terminals including a curved first electric terminal which is brought into direct contact with said operation knob, a flat second electric terminal which is disposed below said first electric terminal and is brought into contact with said first electric terminal at the time that said operation knob presses said first electric terminal, and an insulation member which is disposed between said first electric terminal and said second electric terminal; and (e) a second supporting member having two ends for supporting said electric terminals including screw receiving holes which are formed through both of said ends of said second supporting member, and said second supporting member being fixed to the one side wall of the pipe hose by a plurality of screws passing through the screw receiving holes.

19. An electric power switch as claimed in claim 18, wherein said air suction passage has a cylindrical-shape, and a center line of said air suction passage is the same as a center line of the air suction port.

20. An electric power switch as claimed in claim 18, wherein a diameter of said air suction passage is the same as a diameter of the air suction port.

* * * * *